US007309064B1

(12) United States Patent
Engel

(10) Patent No.: US 7,309,064 B1
(45) Date of Patent: Dec. 18, 2007

(54) PUZZLE WITH MESHING GEAR SECTIONS

(76) Inventor: Douglas A. Engel, 9442 US Highway 85, Littleton, CO (US) 80125

( * ) Notice: Subject to any disclaimer, the term of this patent is extended or adjusted under 35 U.S.C. 154(b) by 0 days.

(21) Appl. No.: 11/061,251

(22) Filed: Feb. 18, 2005

(51) Int. Cl.
*A63F 9/08* (2006.01)

(52) U.S. Cl. ..... 273/153 S; 273/155

(58) Field of Classification Search ..... 273/153 S, 273/157 R, 153 R
See application file for complete search history.

(56) References Cited

U.S. PATENT DOCUMENTS 2,095,046 A 10/1937 Wilner
2,477,441 A 7/1949 Cole
3,172,666 A 3/1965 Ryan
4,415,158 A 11/1983 Engel
4,468,033 A 8/1984 Minami et al.
4,550,040 A * 10/1985 Fisher ..... 273/153 S
4,978,126 A * 12/1990 Morosow et al. ..... 273/153 S
5,100,142 A * 3/1992 Cannata ..... 273/153 S
5,135,225 A * 8/1992 Pszotka et al. ..... 273/153 S
5,244,208 A * 9/1993 Kalapacs et al. ..... 273/153 S

OTHER PUBLICATIONS

Lot MP22 "Jentek #1" puzzle by Doug Engel, auctiond at www.baxterweb.com, on sale more than one year from filing of this application.
Lot MP24 "Hungarian Rings", auctioned at www.baxterweb.com, on sale as early as 1982.

* cited by examiner

*Primary Examiner*—Steven Wong
(74) *Attorney, Agent, or Firm*—Ramon L. Pizarro; Edwin H. Crabtree

(57) ABSTRACT

A puzzle that provides for rearranging different pieces to form a pattern formed from the pieces is disclosed. The puzzle includes at least one generally trilateral piece having three sides, and at least one generally quadrilateral piece. At least two of the sides of the quadrilateral piece have been adapted for engaging the friction enhancing surface on the trilateral piece, so that by surrounding the fixed hub with the trilateral pieces that are separated by the quadrilateral pieces, a continuous round gear surface is formed, that can be used to rotate the trilateral and the quadrilateral pieces together.

10 Claims, 4 Drawing Sheets

PUZZLE WITH MESHING GEAR SECTIONS

BACKGROUND OF THE INVENTION (a) Field of the Invention

This application relates to a puzzle formed from preferably planar sections that are movable relative to one another to allow re-arrangement of the pieces into different patterns.

(b) Discussion of Known Art

In my U.S. Pat. No. 4,415,158 I disclose several arrangements that can be used as a puzzle by allowing a person to re-arrange the components of these arrangements in order to work towards a pattern formed from the components. A highly preferred example of my invention shown in U.S. Pat. No. 4,415,158 is constructed by using a pair of dissimilar basic pieces that are rotated about a circular section. This example has enjoyed limited commercial success, primarily due to the fact that it is difficult to move the pieces relative to one another.

One of the most significant problems associated with the invention disclosed in my U.S. Pat. No. 4,415,158 is that it was rather difficult to rotate the individual components. The dissimilar basic pieces were joined to one another through mating rabbeted portions that are designed to slide along the edges of one another. However, the sliding sections were difficult to move relative to one another.

Other known devices include U.S. Pat. No. 4,468,033 to Minami et al. (Minami.) The Minami device includes geared disks with recessed areas that accept an object that is to be moved from one geared disk to another. Similarly, U.S. Pat. No. 2,477,441 to Cole shows the use of non-circular gears that are mounted on guide studs about which the gears rotate. These devices use the geared shapes to induce rotation about fixed axes.

SUMMARY

It has been discovered that providing a geared puzzle that includes pieces that are moved by translation and rotation about a hub provides a valuable improvement over earlier designs, the puzzle includes:

At least one trilateral piece, with each of the three sides comprising arced sections, and at least two of the arced sections include gear teeth along the arced sections; and At least one quadrilateral piece, each of the four sides of the quadrilateral piece includes arced sections, and at least two of the sides of the quadrilateral include gear teeth along the arced sections, so that by surrounding the fixed hub with the trilateral pieces being separated by the quadrilateral pieces one creates a continuous, round gear surface that can be used to rotate the trilateral and the quadrilateral pieces together.

By providing external components that engage and control the primary or internal components, the puzzle becomes very easy to work, and allows the operator to see the pieces of the puzzle as the operator manipulates the pieces to solve the puzzle.

According to one example of the invention, the quadrilaterals and the trilateral pieces are symmetrical about at least one axis. Additionally, it is contemplated that a round pinion gear may be mated against the round gear surface in order to drive all of the trilateral and quadrilateral pieces together around the fixed hub.

Still further, according to another example of the disclosed invention, it is contemplated that a generally diamond-shaped piece will be positioned between four of the trilateral pieces and two of the quadrilateral pieces. According to this example of the invention, four of the diamond-shaped pieces would be positioned in a cross-shape that is centered about the fixed hub. The four diamond-shaped pieces would share a total of 12 of the trilateral pieces and four of the quadrilateral pieces.

The arrangements shown in the accompanying drawings clearly illustrate that the disclosed pieces and arrangements of these pieces will form meshing geared surfaces that can be easily rotated through at least one pinion gear. Still further, it is contemplated that a pair of pinion gears may be used with the disclosed invention in order to allow the use of two hands while rotating the geared surfaces and re-arranging the pieces to form various color patterns.

It should also be understood that while the above and other advantages and results of the present invention will become apparent to those skilled in the art from the following detailed description and accompanying drawings, showing the contemplated novel construction, combinations and elements as herein described, and more particularly defined by the appended claims, it should be clearly understood that changes in the precise embodiments of the herein disclosed invention are meant to be included within the scope of the claims, except insofar as they may be precluded by the prior art.

DRAWINGS

The accompanying drawings illustrate preferred embodiments of the present invention according to the best mode presently devised for making and using the instant invention, and in which.

Figure 3:
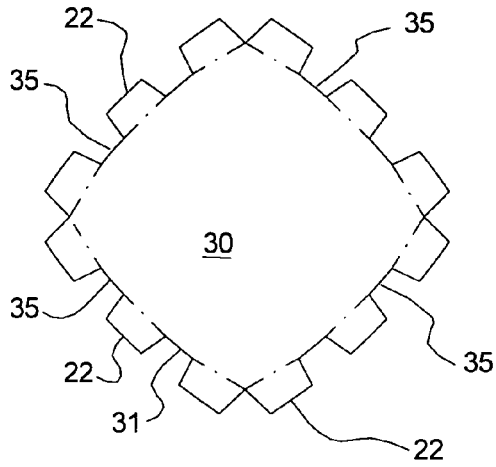

FIG. 3 illustrated another example of the quadrilateral used with the disclosed invention.

Figure 4A:
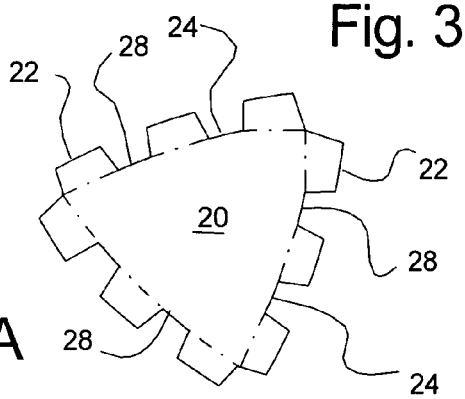
Figure 4:
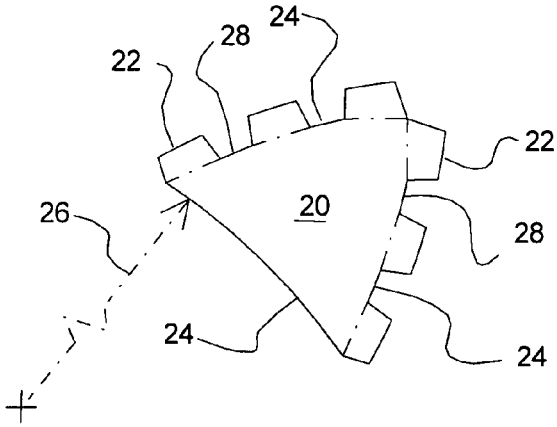

FIG. 4 illustrates an example of a trilateral piece used with the disclosed invention.

FIG. 4A illustrates an example of another trilateral used with the disclosed invention.

Figure 5:
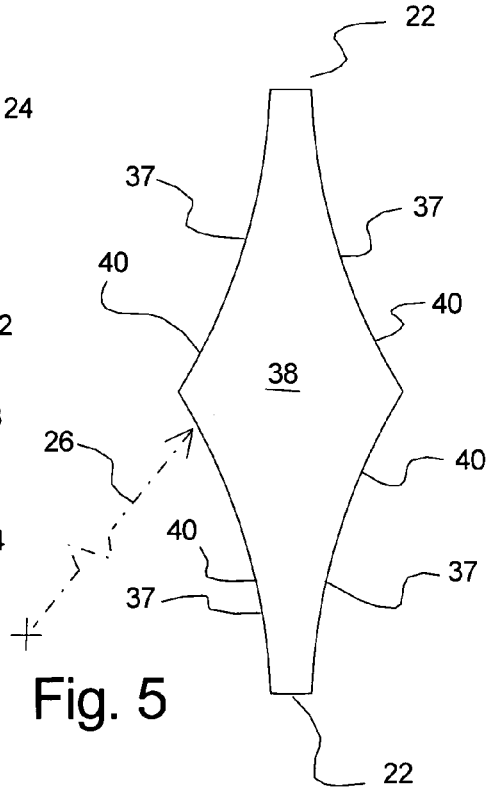

FIG. 5 illustrates an example of the generally diamond-shaped piece used with the disclosed invention.

Figure 6:
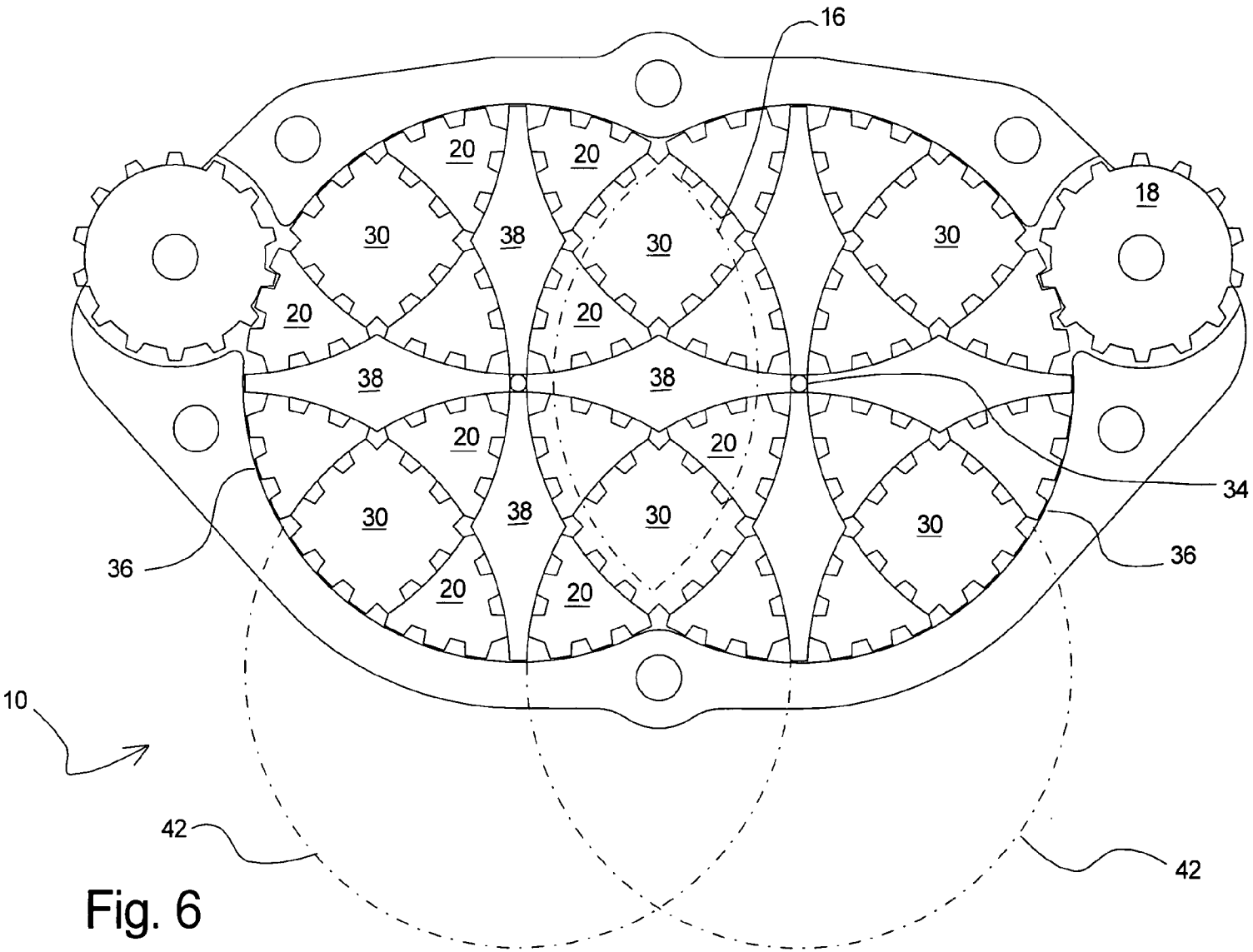

FIG. 6 illustrates an example of the invention using the generally diamond-shaped piece together with the trilateral piece of FIG. 5 and the quadrilateral piece of FIG. 4 to form round gears that share a common area that is formed from the generally diamond-shaped piece, four of the trilateral pieces, and two of the quadrilateral pieces mounted on a support panel and rotated by a pair of pinion gears.

Figure 7:
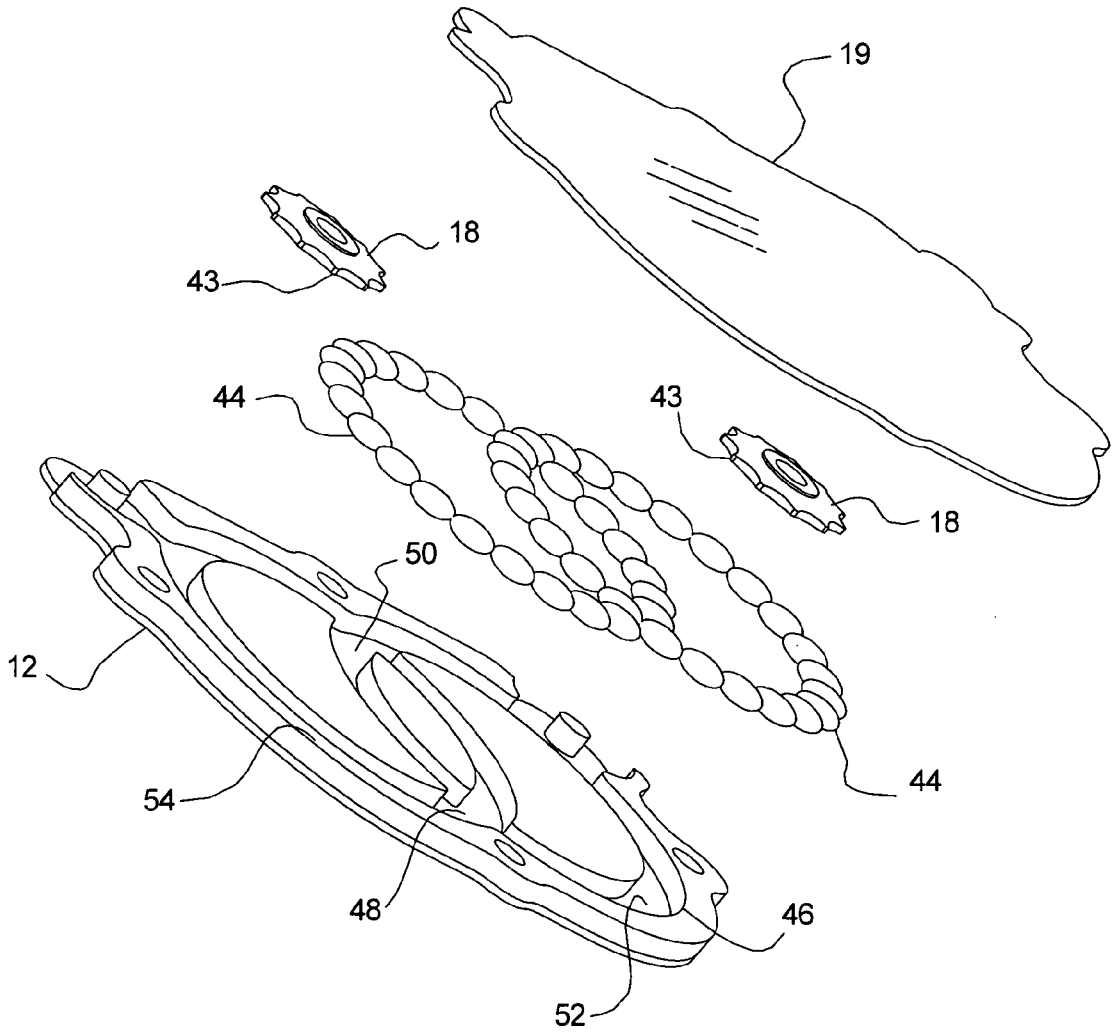

FIG. 7 illustrates an example of an embodiment of a device using the inventive concepts taught herein.

DETAILED DESCRIPTION OF PREFERRED EXEMPLAR EMBODIMENTS

While the invention will be described and disclosed here in connection with certain preferred embodiments, the description is not intended to limit the invention to the specific embodiments shown and described here, but rather the invention is intended to cover all alternative embodiments and modifications that fall within the spirit and scope of the invention as defined by the claims included herein as well as any equivalents of the disclosed and claimed invention.

Figure 1:
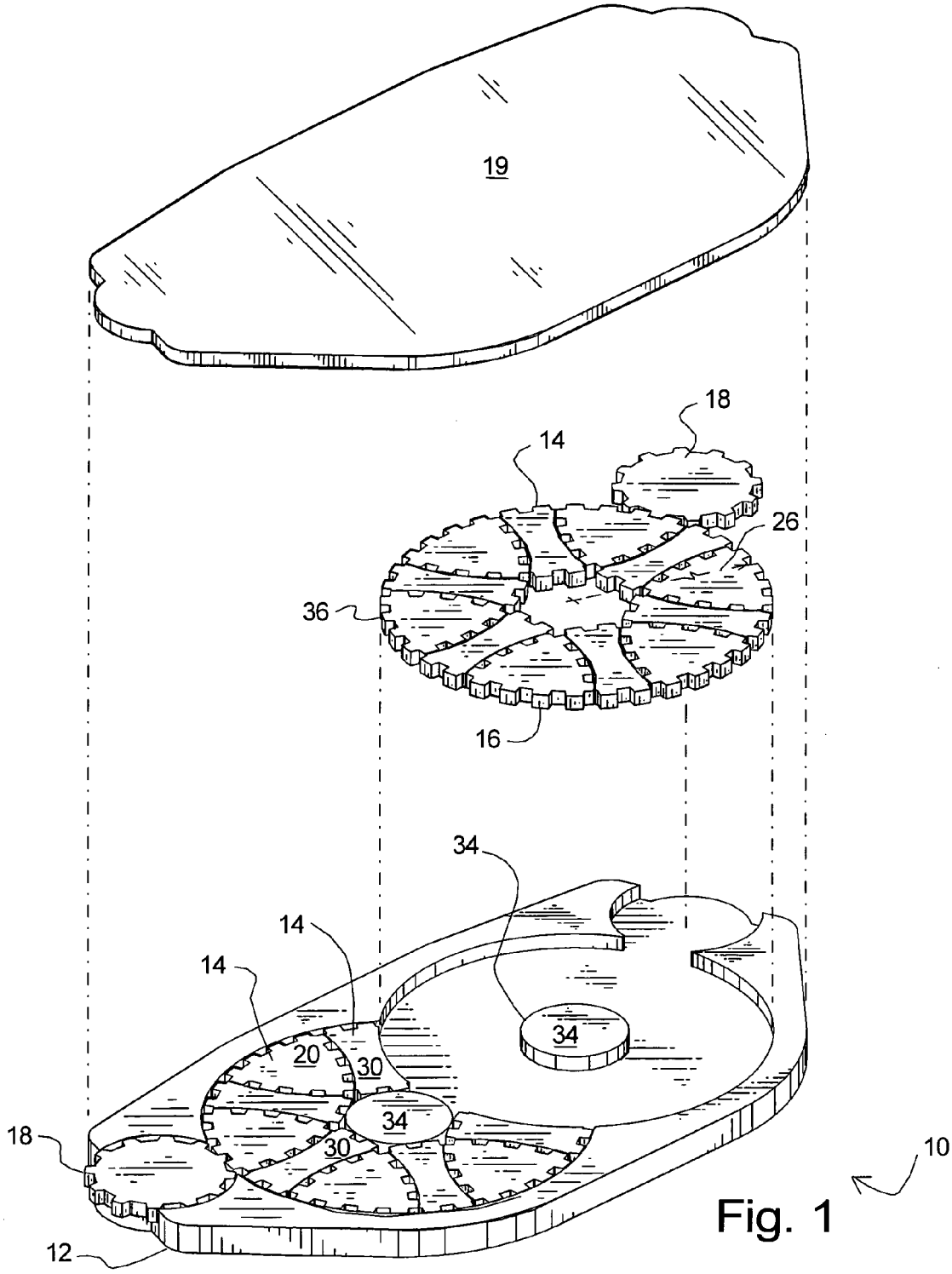
FIG. 1 is a perspective view of a highly preferred embodiment of the invention.

Important features of the disclosed invention will be understood by turning to FIG. 1, where an exploded view of a highly preferred example of the disclosed puzzle 10 is shown. The example of the puzzle 10 shown in FIG. 1 includes a support panel 12 that support the meshing gear sections 14 that are used to form the disclosed puzzle 10. The meshing gear sections 14 share a common area 16 that is formed from the meshing gear sections 14. A set of pinion gears 18 are used to manipulate the meshing gear sections 14 in order to allow the user to mix the position of the meshing gear sections 14 relative to one another. It is contemplated that the individual meshing gear sections 14 may include markings, such as colors, textures, patterns, or other surface decorations that can be used to form patterns or designs through the rearrangement of the meshing gear sections 14. FIG. 1 also illustrates that it is preferred that the entire assembly be contained under a translucent cover 19, and preferably a transparent cover.

FIG. 1 also illustrates that it is contemplated that the meshing gear sections will include at least one generally trilateral piece 20. It is important to note that the term "trilateral" as used herein is meant to refer to generally three sided shapes. The enclosed drawings show that the three-sided shapes include gear teeth 22, which serve to enhance friction and maintain the relative position of the meshing gear sections 14. Thus, "three-sided" refers to the sides that support the gear teeth or friction enhancing projections, and not to the sides of the gear teeth themselves. Of course, the number of sides of the gear teeth simply depends on the number of teeth used in a particular application.

Referring now to FIGS. 1 and 4, it will be understood that the three sides 24 of the trilateral piece 20 will follow a curvature of a constant radius 26. Furthermore, these figures show that it is contemplated that at least two of the sides 24 of the trilateral piece 20 will include a friction enhancing surface, which will preferably be gear teeth 22, along at least two of the sides. In the illustrated embodiments, the trilateral piece 20 will include a pair of convex surfaces 28, each of which will include gear teeth 22 as the friction enhancing mechanism.

Figure 2:
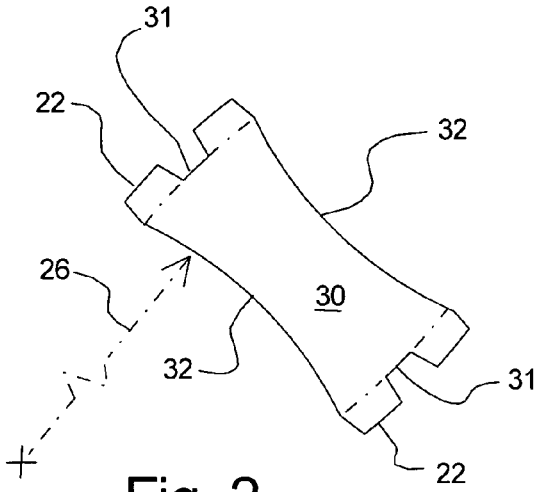
FIG. 2 illustrates an example of the quadrilateral used with the disclosed invention.

As illustrated in FIG. 1, the trilateral piece 20 will cooperate with at least one generally quadrilateral piece 30. Two exampled of the quadrilateral piece are illustrated in FIGS. 2 and 3, which illustrate that the quadrilateral piece 30 will include four sides, two of which will preferably follow a convex curvature 31 of the same radius as the constant radius 26 of the sides of the trilateral piece. The remaining two sides of the quadrilateral piece 30 may be concave and smooth. These concave sides 32 of the quadrilateral will accept the convex portions of the trilateral piece 20 against the quadrilateral piece and allow the gear teeth on the convex surfaces to slide by, next to the quadrilateral piece 30.

FIG. 1 further illustrates that it is contemplated that the support panel 12 will also include a hub 34 that will preferably be fixed, but may be left free, on the support panel 12. The hub 34 will allow placement of the gear sections 14 around the hub 34 such that the trilateral pieces 20 are separated by the quadrilateral pieces 30, forming a continuous round gear surface 36. The continuous round gear surface can be used to rotate the trilateral and the quadrilateral pieces together. Preferably, at least one pinion gear 18 will mesh with the continuous round gear surface 36 and will allow manipulation of the movement of the trilateral pieces 20 and the quadrilateral pieces 30 around the hub 34.

FIG. 1 also illustrates that it is contemplated that a pair of continuous round gear surfaces 36 may be formed, with the continuous round gear surfaces 36 sharing the geared sides of several trilateral pieces 20 and quadrilateral pieces 30. Specifically, FIG. 1 illustrates that the pair of continuous round gear surfaces 36 share a pair of trilateral pieces 20 and one quadrilateral piece 30. In the example shown in FIG. 1, a pair of pinion gears 18 are used to rotate the continuous round gear surfaces 36 independently of one another. This independent rotation will allow the user to mix the gear sections 14 in the common area 16 by manipulating the continuous round gear surfaces 36 to introduce or remove gear sections 14 in the common area 16.

Turning now to FIGS. 3, 5 and 6 it will be understood that in an example of the invention, the quadrilateral piece 30 may include four convex sides 35 while another four-sided piece includes four concave sides 37 creating a diamond shaped piece 38. Each of the convex sides of the quadrilateral piece 30 follows the radius of curvature found on the sides of the trilateral piece 20. Similarly, the sides 40 of the diamond shaped piece 38 follow the same radius of curvature as the convex sides of the trilateral piece 20.

FIG. 6 illustrates the use of the trilateral pieces 20, the quadrilateral pieces 30, and the diamond shaped pieces 38 to create the puzzle. In this example surrounding each hub 34 with four of the diamond shaped pieces, twelve trilateral pieces 20, and four quadrilateral pieces 30 forms each continuous round gear surface 36. One of the diamond shaped pieces 38, together with two quadrilateral pieces 30 and four trilateral pieces 20 are shared to form two intersecting continuous round gear surfaces 36.

FIG. 6 also illustrates, as indicated by the phantom line 42, that adding more hubs 34 can form additional continuous round gear surfaces 36, diamond shaped pieces 38, quadrilateral pieces 30, and trilateral pieces 20. Similarly, the example shown in FIG. 1 can be expanded to provide additional continuous round gear surfaces 36 by adding hubs 34, quadrilateral pieces 30 and trilateral pieces 20 to the support surface 36, as indicated by the phantom line 42. Adding a pinion gear 18 to cooperate with each additional continuous round gear surface 36 would facilitate the manipulation of the pieces. The added pieces of the expanded puzzles will increase the complexity of the puzzle and hence the difficulty of achieving a desired pattern.

It is important to note that the inventive principles taught here can be reflected in other embodiments. For example, FIG. 7 illustrates that it is contemplated that a puzzle that includes a support panel 12 with at least two pinion gears 18 with teeth 43 that accept the similarly shaped pieces 44 and move them along the closed loop tracks 46. The pinion gears 18 are mounted from the support panel 12 with the teeth 43 extending into the closed loop tracks 46 in order to allow the user to move the similarly shaped pieces along the tracks 46, and thus manipulate the arrangement of similarly shaped pieces 44 along closed loop tracks 46.

FIG. 7 illustrates that the closed loop tracks 46 intersect one another at two locations, referenced as the first intersection 48 and the second intersection 50. The first intersection 48 and the second intersection 50 are used to mix the similarly shaped pieces 44 by diverting the pieces being moved along the first closed loop track 52 onto the second closed loop track 54. It is contemplated that the similarly shaped pieces may be grouped by color or by placing patterns or other indicia on the similarly shaped pieces.

Thus it can be appreciated that the above described embodiments are illustrative of just a few of the numerous variations of arrangements of the disclosed elements used to carry out the disclosed invention. Moreover, while the invention has been particularly shown, described and illustrated in detail with reference to preferred embodiments and modifications thereof, it should be understood that the foregoing and other modifications are exemplary only, and that equivalent changes in form and detail may be made without departing from the true spirit and scope of the invention as claimed, except as precluded by the prior art.

What is claimed is:

1. A puzzle that provides for rearranging different pieces about a first fixed hub, the rearrangement of the pieces changing a pattern formed from the pieces, the puzzle comprising:

a plurality of generally trilateral pieces having three sides, the sides of the trilateral pieces following a curvature, each of the trilateral pieces comprising two convex sides and one concave side, the convex sides including gear teeth while the concave side does not include gear teeth; and a plurality of generally quadrilateral pieces having four sides, each of the sides of the quadrilateral pieces following the curvature, and at least two of the sides of each the quadrilateral pieces being convex and having gear teeth adapted for mating with the gear teeth on the trilateral piece, so that by surrounding the fixed hub with the trilateral pieces such that the trilateral pieces are separated by the quadrilateral pieces a continuous round friction enhancing surface is formed, so that the round friction enhancing surface can be used to rotate the trilateral and the quadrilateral pieces together.

2. A puzzle according to claim 1 wherein said sides of the quadrilateral piece are convex.

3. A puzzle according to claim 1 and further comprising at least one pinion gear, the pinion gear engaging the gear teeth, so that rotation of the pinion gear rotates the trilateral piece and the quadrilateral piece about the fixed hub.

4. A puzzle according to claim 3 comprising at least ten of the trilateral pieces, the trilateral pieces and the quadrilateral pieces being adapted for being arranged in an alternating manner about the fixed hub and a second fixed hub.

5. A puzzle according to claim 3 wherein the quadrilateral pieces and the trilateral pieces include a surface marking and one arrangement of the quadrilateral pieces and the trilateral pieces forms a specific pattern from the markings on the quadrilateral and the trilateral pieces.

6. A puzzle that includes pieces that are moved by translation and rotation of the pieces in order to allow the rearrangement of the pieces and produce various patterns from the pieces, the puzzle comprising:

a support panel, the support panel supporting a pair of hubs and a pair of pinion gears mounted from the panel;

at least ten generally trilateral pieces, each trilateral piece having two convex sides that follow a curvature of a radius and a concave side, the two convex sides of the trilateral piece including gear teeth and the concave side not having gear teeth; and at least eleven generally quadrilateral pieces, each having four sides, each of the sides of the quadrilateral pieces being either concave or convex and following the curvature of a radius, and at least two of the sides of each of the quadrilateral pieces being convex and including gear teeth while the concave sides do not have gear teeth, so that by surrounding each of the fixed hubs with the trilateral pieces being separated by the quadrilateral pieces one creates a continuous, round gear surface that can be used to rotate the trilateral and the quadrilateral pieces together by rotating the pinion gears.

7. A puzzle according to claim 6 and further comprising seven diamond shaped pieces, the diamond shaped pieces having four concave sides, each of the concave sides of the diamond shaped pieces being adapted for accepting one of the convex sides of one of the trilateral pieces.

8. A puzzle according to claim 6 wherein the gears of said trilateral pieces and said quadrilateral pieces are concealed below the sides of the trilateral pieces and the quadrilateral pieces.

9. A puzzle according to claim 6 wherein said support panel comprises a base and a cover that retains the trilateral pieces and the quadrilateral pieces against the base.

10. A puzzle according to claim 9 wherein said cover comprises a translucent panel.

* * * * *